US007077794B1

(12) United States Patent
Bray

(10) Patent No.: US 7,077,794 B1
(45) Date of Patent: Jul. 18, 2006

(54) INFLATABLE EXERCISE BELT AND METHOD OF USE

(76) Inventor: Craig A. Bray, 1811&1/2 Citrus Ave., Redlands, CA (US) 92374

( * ) Notice: Subject to any disclaimer, the term of this patent is extended or adjusted under 35 U.S.C. 154(b) by 42 days.

(21) Appl. No.: 11/051,746

(22) Filed: Feb. 4, 2005

Related U.S. Application Data

(60) Provisional application No. 60/545,012, filed on Feb. 17, 2004.

(51) Int. Cl.
*A63B 23/02* (2006.01)

(52) U.S. Cl. ..... 482/140; 482/111; 482/112; 602/13; 602/19

(58) Field of Classification Search ..... 482/111, 482/112, 140; 601/148–152, 44; 602/13; 128/DIG. 20; 441/106, 114–5, 108, 117, 441/119

See application file for complete search history.

(56) References Cited

U.S. PATENT DOCUMENTS

| | | | | |
|---|---|---|---|---|
| 3,659,843 | A * | 5/1972 | Kojigian, Jr. | 482/139 |
| 4,824,105 | A * | 4/1989 | Goldenberg | 482/113 |
| 5,450,858 | A * | 9/1995 | Zablotsky et al. | 128/876 |
| 5,628,721 | A * | 5/1997 | Arnold et al. | 602/19 |
| 5,713,840 | A * | 2/1998 | Brentham | 602/19 |
| 5,954,556 | A * | 9/1999 | Powers | 441/88 |
| 6,520,893 | B1 * | 2/2003 | Bray | 482/140 |
| 6,629,942 | B1 * | 10/2003 | Tubbs | 602/13 |
| 6,672,311 | B1 * | 1/2004 | Rindfleish | 128/874 |

* cited by examiner

*Primary Examiner*—Danton D. DeMille
*Assistant Examiner*—Allana Lewin
(74) *Attorney, Agent, or Firm*—Ted Masters

(57) ABSTRACT

An inflatable exercise belt which is placed around the abdomen and lower back of a user has one inflatable air chamber for the abdomen and two spaced apart inflatable air chambers for the lumbar region of the back. When worn by the user and inflated, the two inflatable chambers exert pressure upon the upper and lower portions of the lumbar vertebrae. The belt also has elastic portions which enable it to better conform to the body of the user.

8 Claims, 4 Drawing Sheets

20
21
22
24
25
26
27
29
30
32
33
36
38
40
42
44
46
48
50

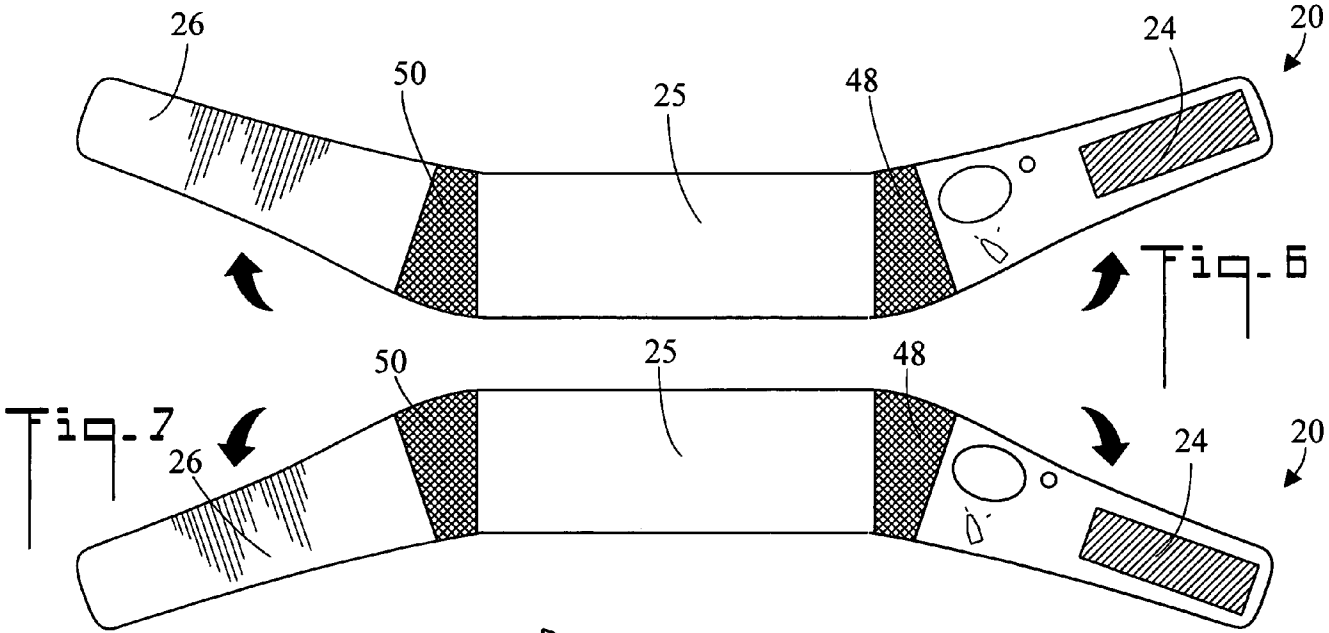
Fig-6
Fig-7
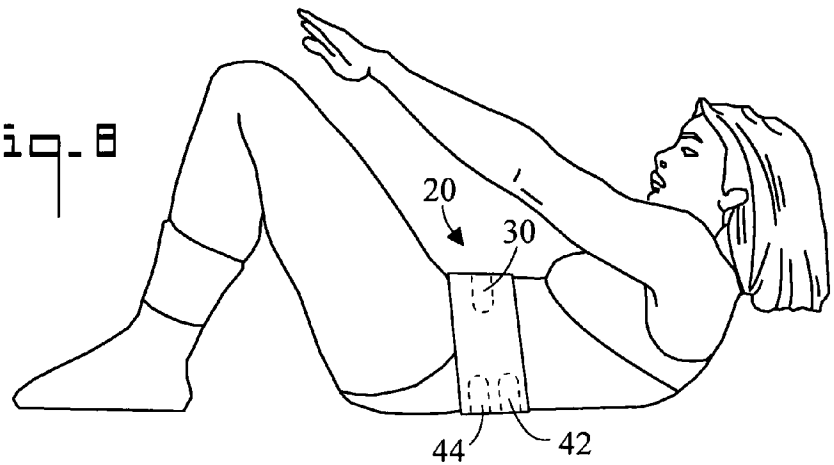
Fig-8

INFLATABLE EXERCISE BELT AND METHOD OF USE

CROSS REFERENCE TO RELATED APPLICATION

This application claims the filing benefit under 35 U.S.C. §119(e) of U.S. Provisional Application No. 60/545,012, filed Feb. 17, 2004, which is included herein by reference.

TECHNICAL FIELD

The present invention pertains generally to physical fitness, and in particular to an exercise belt having three inflatable air chambers. One chamber is positioned adjacent to the abdomen of a user, and two chambers are positioned adjacent to the lower back of the user.

BACKGROUND OF THE INVENTION

Exercise belts are well known in the art. These belts are typically designed to fit around the waist of a user, and are utilized when the user is exercising or engaged in other activities to flatten and firm abdominal muscles. The abdominal muscles are stimulated by having points of applied external pressure. For example, when an object is slowly pushed into the stomach muscles, the muscles automatically resist the pressure by tightening. The purpose for stimulating the stomach muscles is to exercise the muscles efficiently. This tones the muscles. The exercise belt is optimally used in conjunction with regular exercise to enhance the results of the exercise.

Alternatively, exercise belts can be utilized to provide bracing and support for the back of the user, particularly user's who are afflicted with back problems. For example, U.S. Pat. No. 5,628,721 illustrates a back support assembly which includes a bulb pump which when pumped or squeezed by the user inflates an air cushion to exert the desired pressure and fit against the user's lower back. The cushion is secured to the middle of the elastic belt, which is adapted to wrap around the user's back to position the air cushion against the middle of the user's back. Opposing adjustment straps are attached to the back of the strap. With the belt secured around the user the adjustment straps can be pulled and releasably secured to the belt and/or each other at respective positions exerting the desired force on the air cushion and against the user's back. The bulb pump is conveniently attached to and carried by one of the adjustment straps. It is secured to the rear of that strap, and has its rounded forward portion extending out through an opening in the strap, operatively accessible for inflation/deflation by the user. That is, with this mounting arrangement the bulb pump is out of the way, but still readily accessible for squeeze pumping action by the user, and by its shape, construction and location advantageously has a low profile.

U.S. Pat. No. 5,450,858 discloses an air inflatable belt worn by a person for support in the lumbar and sacral regions of the body has an inner wall, which faces the body of the person, provided with one or more permanent magnet arrangements producing magnetic fields directed toward the person's body. The permanent magnet arrangements may be provided by one or more flexible magnetic sheets received in a pocket or pockets on the inner wall of the belt, or by permanent magnet particles embedded in the inner wall of the belt and magnetized to provide desired magnetic field patterns. The belt includes an inflatable bladder or bladders which may be removably supported on the belt.

U.S. Pat. No. 6,520,893 is directed to an inflatable exercise belt for placement around the abdomen of a user includes a substantially belt-shaped body having a first end portion and an opposite second end portion. A selectively inflatable air chamber is disposed at first end portion. Backing is disposed adjacent to the inflatable air chamber, so that when the inflatable air chamber is inflated, the inflatable air chamber expands in a direction away from backing thereby exerting pressure on the abdomen of the user.

BRIEF SUMMARY OF THE INVENTION

The present invention is directed to an inflatable exercise belt which can be worn during exercise such as aerobics or sports activities, or during other activities such as running, walking, or riding. The exercise belt flattens and firms the abdominal muscles of the user, and also helps with posture by giving support to the lower back. An inflatable air chamber or bladder places isometric pressure against the abdominal muscles. This causes the abdominal muscles to flex, and react. This abdominal pressure also causes the back muscles to react, causing the wearer to stand straighter with better posture. Additionally, the belt holds firmly against the back of the user, giving the user even more support. The belt also includes two inflatable air chambers which exert pressure upon the lumbar region of the back of the user. This feature provides kidney support for truck drivers, motorcycle riders, weight lifters, and the like. Elastic sections in the belt will expand around the hips of the user and thereby better conform to the shape of the user's body.

In accordance with a preferred embodiment of the invention, an inflatable exercise belt is designed to be placed around the abdomen and lower back of a user. The inflatable exercise belt includes a body having a longitudinal axis, a first end portion, a middle portion, and a second end portion. A first elongated inflatable air chamber is disposed at the first end portion and is oriented parallel to the longitudinal axis. Spaced apart second and third elongated inflatable chambers are disposed at the middle portion and are also oriented parallel to the longitudinal axis. When the inflatable exercise belt is worn by a user, the first elongated inflatable chamber is disposed adjacent to the abdomen of a user, and the second and third elongated inflatable chambers are disposed adjacent to the back of the user.

In accordance with an aspect of the invention, the spaced apart second and third elongated inflatable chambers defining a gap of between about one inch to about one and one half inches therebetween.

In accordance with another aspect of the invention, the back of the user has five lumbar vertebrae, the five lumbar vertebrae having an upper portion, a middle portion, and a lower portion. When placed upon the user and inflated, the second and third elongated inflatable air chambers exert pressure upon the upper and lower portions respectively of the five lumbar vertebrae of the user but not upon the middle portion.

In accordance with another aspect of the invention, the first elongated inflatable chamber is separately inflatable from the second and third elongated inflatable chambers.

In accordance with another aspect of the invention, a first elastic portion is disposed between the first end portion and the middle portion, and a second elastic portion is disposed between the second end portion and the middle portion.

Other aspects of the present invention are apparent from the following detailed description, taken in conjunction with the accompanying drawings, which illustrate, by way of example, the principles of the invention.

BRIEF DESCRIPTION OF THE DRAWINGS

FIG. 6 is an outside plan view showing elastic portions which allow the inflatable exercise belt better conform to the body of a user;

FIG. 7 is another outside plan view showing the elastic portions;

FIG. 8 is a side elevation view of a user using the present invention; and,

DETAILED DESCRIPTION OF THE INVENTION

Figures 1, 2, 3:
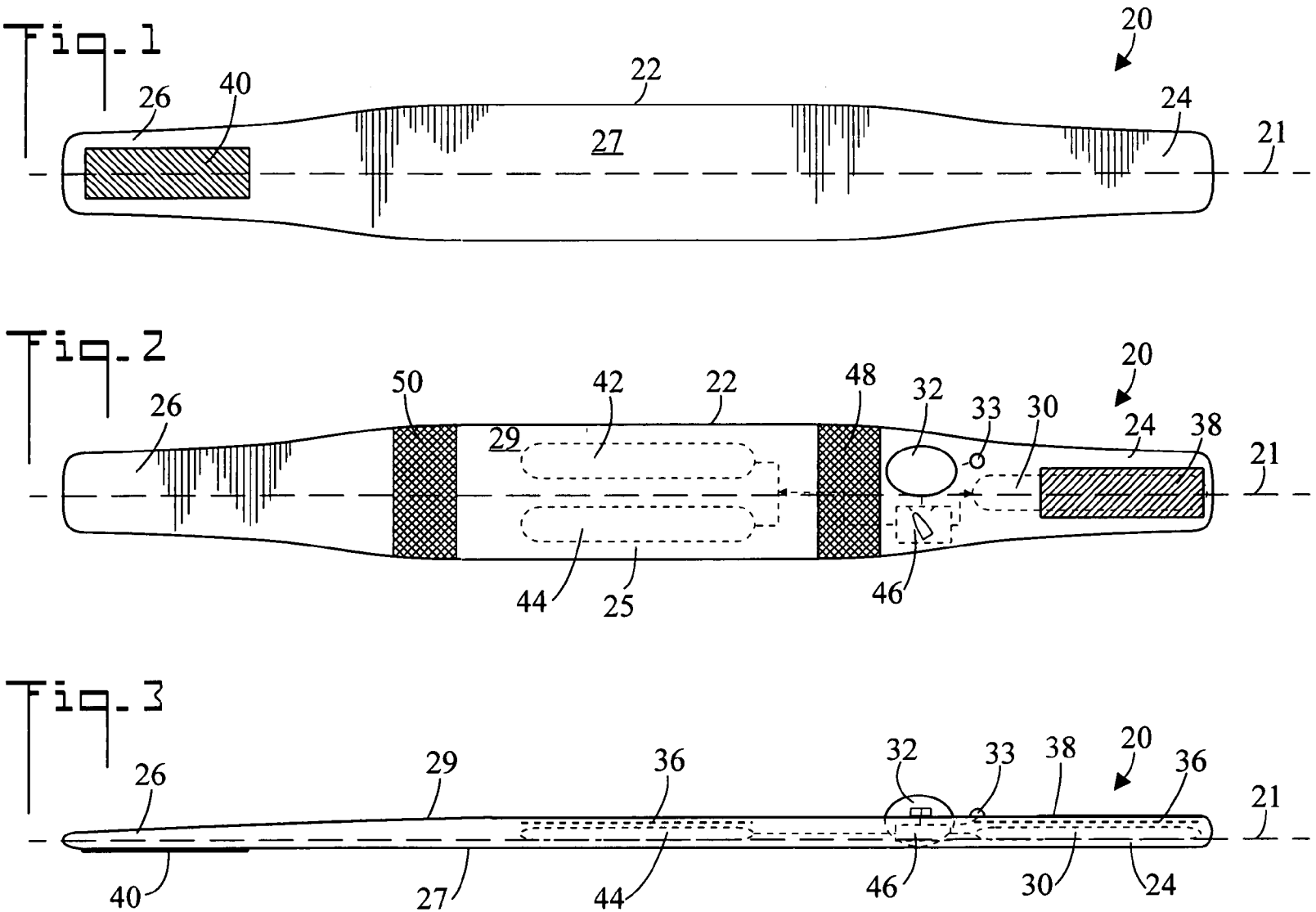
FIG. 1 is an inside plan view of an inflatable exercise belt in accordance with the present invention.
FIG. 2 is an outside plan view of the inflatable exercise belt.
FIG. 3 is a side elevation view of the inflatable exercise belt.

Referring initially to FIGS. 1–3, there are illustrated inside plan, outside plan, and side elevation views respectively of an inflatable exercise belt in accordance with the present invention, generally designated as 20. Inflatable exercise belt 20 includes a substantially belt-shaped body 22 having a longitudinal axis 21, a first end portion 24, a middle portion 25, and a second end portion 26 opposite first end portion 24. Belt-shaped body 22 has a first side 27 or inside, which when exercise belt 20 is worn by a user, is placed against the body of the user, and an opposite second side 29 or outside. A first elongated inflatable air chamber 30 is disposed at first end portion 24, and is oriented parallel to longitudinal axis 21. In a preferred embodiment inflatable air chamber 30 is fabricated from rubber, and a bulb-type pump 32 communicates with first elongated inflatable air chamber 30 for selectively inflating same. A control valve 33 allows air from pump 32 to inflate first elongated inflatable air chamber 30, or alternatively allows air to be emptied from first elongated inflatable air chamber 30. When inflatable air chamber 30 is inflated, it has a substantially cylindrical shape having a diameter of between about 0.5 inches and 4 inches and a length of about 10 inches (refer to FIG. 4). Backing 36 (also refer to FIG. 5) is disposed adjacent to first elongated inflatable air chamber 30, so that when first elongated inflatable air chamber 30 is inflated, it expands in a direction away from backing 36 and toward inside 27. In an embodiment of the invention, backing 36 is fabricated from a firm substantially flat piece of plastic. One 38 of hook and loop fasteners is disposed at first end portion 24 on second side 29, and the other 40 of hook and loop fasteners is disposed at second end portion 26 on first side 27. The hook and loop fasteners 38 and 40 are utilized to retain inflatable exercise belt 20 about the waist of the user.

Inflatable exercise belt 20 also includes spaced apart second 42 and third 44 elongated inflatable chambers which are disposed at middle portion 25 and are oriented parallel to longitudinal axis 21. In a preferred embodiment of the invention, a gap G of about one inch to about one and one half inches exists between second 42 and third 44 elongated inflatable chambers (refer to FIG. 9). When inflatable exercise belt 20 is worn by a user, first elongated inflatable chamber 30 is disposed adjacent to the abdomen of a user, and second 42 and third 44 elongated inflatable chambers are disposed adjacent to the back of the user. Backing 36 is also disposed adjacent to second 42 and third 44 elongated inflatable air chambers, so that when second 42 and first 44 elongated inflatable air chambers are inflated, they expand in a direction away from backing 36 and toward inside 27.

First elongated inflatable chamber 30 is separately inflatable from second 42 and third 44 elongated inflatable chambers. A two way air valve 46 selectively controls either the inflation of first elongated inflatable chamber 30, or the inflation of second 42 and third 44 elongated inflatable air chambers. This allows the pressure of first 30 elongated inflatable air chamber to be adjusted to a different pressure from second 42 and third 44 elongated inflatable air chambers. Such a two way air valve may be procured from Pneumadyn Inc. of Plymouth, Minn. (e.g part numbers AMM-20-1616 and HMM-20-1616).

A first elastic portion 48 is disposed between first end portion 24 and middle portion 25, and a second elastic portion 50 disposed between second end portion 26 and middle portion 25 (also refer to FIGS. 6 and 7 and the discussion pertaining thereto).

Figure 4:
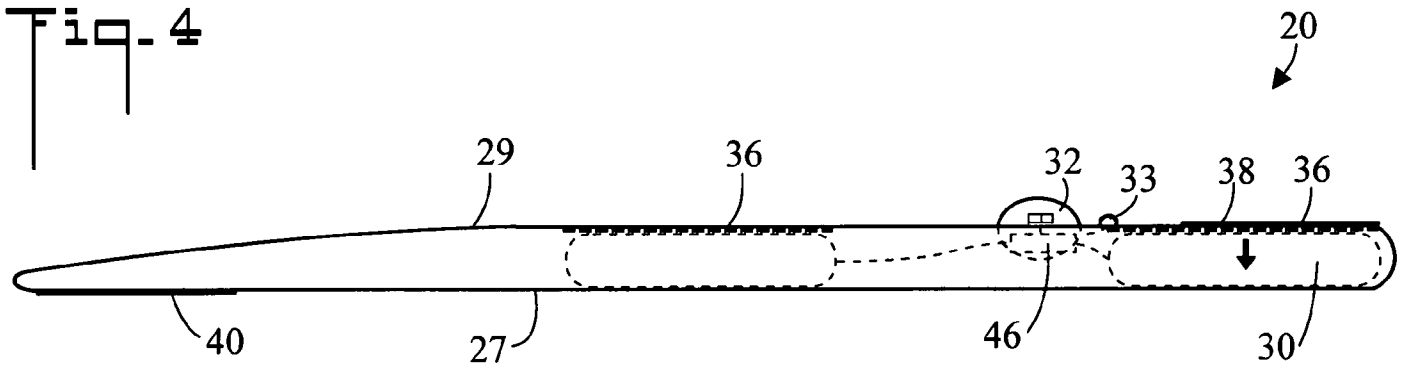
FIG. 4 is a side elevation view of the inflatable exercise belt with the inflatable air chambers inflated.

FIG. 4 is a side elevation view of inflatable exercise belt 20 with first 30, second 42, and third 44 elongated inflatable air chambers inflated. Backing 36 causes inflatable air chambers 30, 42, and 44 expand toward the inside 27 of the exercise belt 20, thereby exerting pressure directly on the user. Absent backing 36, elongated inflatable air chambers 30, 42, and 44 would balloon outwardly toward outside 29.

Figure 5:
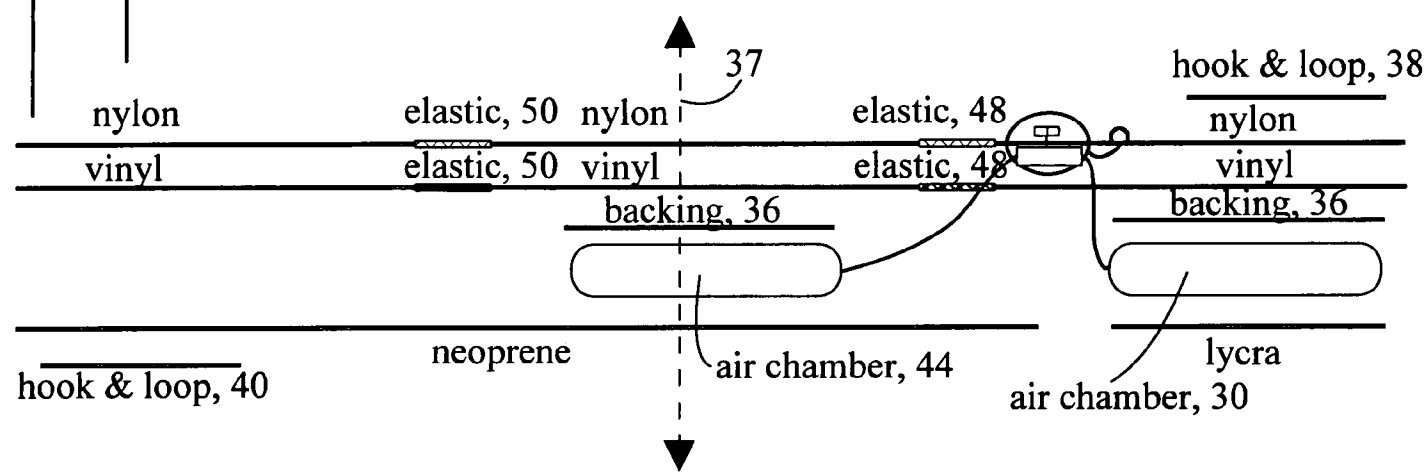
FIG. 5 is a simplified exploded cross sectional view of FIG. 3 showing the various layers of the inflatable exercise belt.

FIG. 5 is a simplified exploded (along line 37) cross sectional view of FIG. 3 showing the various layers of the inflatable exercise belt 20. Inflatable exercise belt 20 is fabricated from layers of rip stop nylon, neoprene, vinyl, and lycra. Additionally, elastic portions 48 and 50, backing 36, elongated inflatable air chambers 30 and 44, and hook an loop fasteners 38 and 40 are depicted.

FIG. 6 is an outside plan view showing elastic portions 48 and 50 which allow the inflatable exercise belt better conform to the body of a user. In the shown embodiment, elastic portions allow the end portions 24 and 26 to bend upwardly with respect to middle portion 25.

FIG. 7 is another outside plan view showing the elastic portions 48 and 50. In the shown embodiment, elastic portions 48 and 50 allow the end portions 24 and 26 to bend downwardly with respect to middle portion 25.

FIG. 8 is a side elevation view of a user wearing inflatable exercise belt 20. When inflatable exercise belt 20 is placed around the waist of a user, elongated inflatable air chamber 30 is disposed in a substantial horizontal orientation over the abdominal muscles of the user, and elongated inflatable air chambers 42 and 44 are disposed adjacent to the lumbar region of the user's back.

Figure 9:
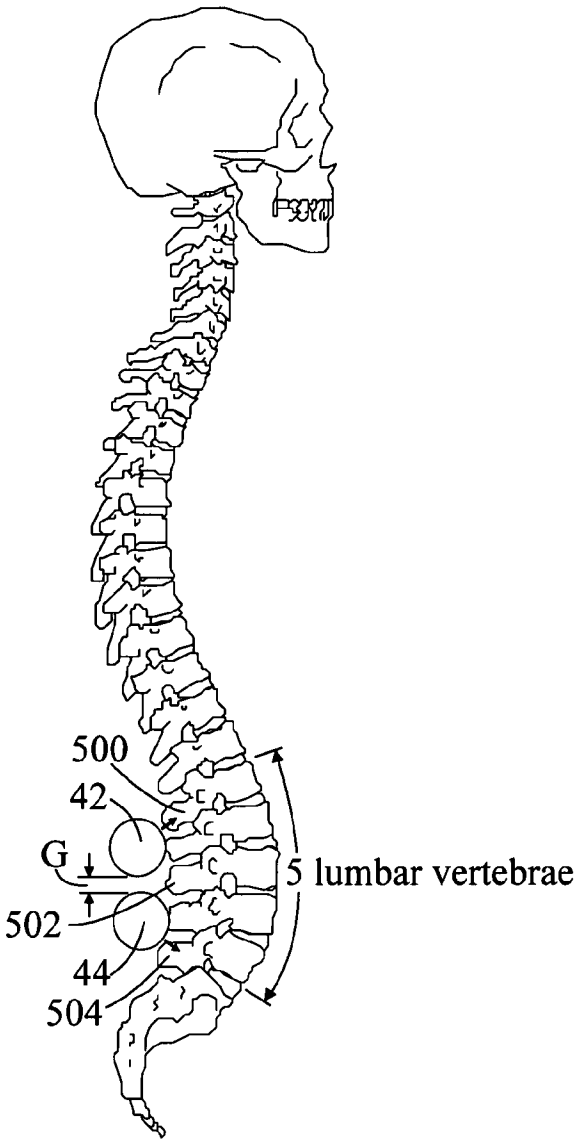
FIG. 9 is a side elevation view showing the lumbar region of the user's back.

FIG. 9 is a side elevation view showing the lumbar region of the user's back. The lumbar region comprises five vertebrae. The lumbar region is divided into an upper portion 500, a middle portion 502, and a lower portion 504. When exercise belt 20 is worn by a user and the air chambers inflated, second 42 and third 44 elongated inflatable air chambers form to the back of the user and exert pressure upon the upper 500 and lower 504 portions respectively of the five lumbar vertebrae of the user but not upon the middle portion 502. This upper and lower pressure has been found effective in providing optimum lower back support. The gap G of about one inch to about one and one half inches between second elongated inflatable air chamber 42 and third inflatable air chamber 44 prevents pressure from being exerted upon middle portion 502.

In terms of use, a method for applying pressure to the back of a user having an abdomen, a back having five lumbar vertebrae, the five lumbar vertebrae having an upper portion 500, a middle portion 502, and a lower portion 504, comprising:

(a) providing an inflatable exercise belt 20 including:

a substantially belt-shaped body 22 having a longitudinal axis 21, a first end portion 24, a middle portion 25, and a second end portion 26;

a first elongated inflatable air chamber 30 disposed at first end portion 24 and oriented parallel to longitudinal axis 21; and, spaced apart second 42 and third 44 elongated inflatable chambers disposed at middle portion 25 and oriented parallel to longitudinal axis 21;

(b) placing inflatable exercise belt 20 around the user so that first elongated inflatable chamber 30 is disposed adjacent to the abdomen of a user, the second 42 elongated inflatable chamber is disposed adjacent to the upper portion 500 of the five lumbar vertebrae, and the third elongated inflatable chamber 44 is disposed adjacent to the lower portion 504 of the five lumbar vertebrae;

(c) inflating second 42 and third 44 elongated inflatable chambers, wherein second elongated inflatable chamber 42 exerts pressure upon upper portion 500 of the five lumbar vertebrae, and third elongated inflatable chamber 44 exerts pressure upon the lower portion 504 of the five lumbar vertebrae.

The method further including:

in step (a), spaced apart second 42 and third 44 elongated inflatable chambers defining a gap of between about one inch to about and one and one half inches therebetween.

The method further including:

in step (a), first elongated inflatable chamber 30 separately inflatable from second 42 and third 44 elongated inflatable chambers.

The method further including:

in step (a), a first elastic portion 48 disposed between first end portion 24 and middle portion 25, and a second elastic portion 50 disposed between second end portion 26 and middle portion 25.

The preferred embodiments of the invention described herein are exemplary and numerous modifications, variations, and rearrangements can be readily envisioned to achieve an equivalent result, all of which are intended to be embraced within the scope of the appended claims.

The invention claimed is:

1. An inflatable exercise belt for a user having an abdomen and a back, said inflatable exercise belt comprising:

a body having a longitudinal axis, a first end portion, a middle portion, and a second end portion;

a first elongated inflatable air chamber disposed at said first end portion and oriented parallel to said longitudinal axis;

spaced apart second and third elongated inflatable chambers disposed at said middle portion and oriented parallel to said longitudinal axis;

said first elongated inflatable chamber being separately inflatable from said second and third elongated inflatable chambers thereby allowing the pressure of said first elongated inflatable chamber to be adjusted to a different pressure from said second and third elongated inflatable chambers; and, wherein when said inflatable exercise belt is worn by a user during various exercise activities, said first elongated inflatable chamber is disposed adjacent to the abdomen of a user placing isometric pressure against the abdominal muscles thereby causing the abdominal muscles to flex and react, and said second and third elongated inflatable chambers are disposed adjacent to the back of the user.

2. The inflatable exercise belt according to claim 1, further including:

said spaced apart second and third elongated inflatable chambers defining a gap of between about one inch to about one and one half inches therebetween.

3. The inflatable exercise belt according to claim 1, the back of the user having five lumbar vertebrae, the five lumbar vertebrae having an upper portion, a middle portion, and a lower portion, said inflatable exercise belt further including:

when inflated, said second and third elongated inflatable air chambers exert pressure upon the upper and lower portions respectively of the five lumbar vertebrae of the user but not upon the middle portion.

4. The inflatable exercise belt according to claim 1, further including:

a first elastic portion disposed between said first end portion and said middle portion, and a second elastic portion disposed between said second end portion and said middle portion.

5. The inflatable exercise belt according to claim 1, the back of the user having five lumbar vertebrae, the five lumbar vertebrae having an upper portion, a middle portion, and a lower portion, said inflatable exercise belt further including:

said spaced apart second and third elongated inflatable chambers defining a gap of between about one inch to about one and one half inches therebetween;

when inflated, said second and third elongated chambers exerting pressure upon the upper and lower portions respectively of the five lumbar vertebrae of the user but not upon the middle portion;

said first elongated inflatable chamber separately inflatable from said second and third elongated inflatable chambers; and, a first elastic portion disposed between said first end portion and said middle portion, and a second elastic portion disposed between said second end portion and said middle portion.

6. A method for applying pressure to the back of a user having an abdomen, a back having five lumbar vertebrae, the five lumbar vertebrae having an upper portion, a middle portion, and a lower portion, comprising:

(a) providing an inflatable exercise belt including:

a body having a longitudinal axis, a first end portion, a middle portion, and a second end portion;

a first elongated inflatable air chamber disposed at said first end portion and oriented parallel to said longitudinal axis; and, spaced apart second and third elongated inflatable chambers disposed at said middle portion and oriented parallel to said longitudinal axis;

said first elongated inflatable chamber being separately inflatable from said second and third elongated inflatable chambers, thereby allowing the pressure of said first elongated inflatable chamber to be adjusted to a different pressure from said second and third elongated inflatable chambers;

(b) placing said inflatable exercise belt around the user so that said first elongated inflatable chamber is disposed adjacent to the abdomen of a user, and said second elongated inflatable chamber is disposed adjacent to the upper portion of the five lumbar vertebrae, and said third elongated inflatable chamber is disposed adjacent to the lower portion of the five lumbar vertebrae; and, (c) inflating said second and third elongated inflatable chambers, wherein said second elongated inflatable chamber exerts pressure upon the upper portion of the five lumbar vertebrae, and said third elongated inflatable chamber exerts pressure upon the lower portion of the five lumbar vertebrae.

7. The method of claim 6, further including:

in step (a), said spaced apart second and third elongated inflatable chambers defining a gap of between about one inch to about one and one half inches therebetween.

8. The method of claim 6, further including:

in step (a), a first elastic portion disposed between said first end portion and said middle portion, and a second elastic portion disposed between said second end portion and said middle portion.

* * * * *